US008666297B2

(12) United States Patent
Honda et al.

(10) Patent No.: US 8,666,297 B2
(45) **Date of Patent: *Mar. 4, 2014**

(54) IMAGE FORMING APPARATUS WHICH DETERMINES WHETHER A SHEET STACKING UNIT IS FULL

(75) Inventors: Haruyuki Honda, Osaka (JP); Hiroshi Fujiwara, Osaka (JP); Tomoyoshi Yamazaki, Osaka (JP); Toshikane Nishii, Osaka (JP); Mizuna Tanaka, Osaka (JP)

(73) Assignee: Ricoh Company, Ltd., Tokyo (JP)

( * ) Notice: Subject to any disclaimer, the term of this patent is extended or adjusted under 35 U.S.C. 154(b) by 274 days.

This patent is subject to a terminal disclaimer.

(21) Appl. No.: 12/929,628

(22) Filed: Feb. 4, 2011

(65) Prior Publication Data

US 2011/0217058 A1 Sep. 8, 2011

(30) Foreign Application Priority Data

Mar. 3, 2010 (JP) ..... 2010-047070

(51) Int. Cl.
*G03G 15/00* (2006.01)
*B65H 7/00* (2006.01)

(52) U.S. Cl.
USPC ..... 399/405; 399/43; 271/256

(58) Field of Classification Search
CPC ..... B65H 43/06; B65H 2301/541
USPC ..... 399/405, 16, 43; 271/207, 256, 258.03
See application file for complete search history.

(56) References Cited

U.S. PATENT DOCUMENTS

| | | | | |
|---|---|---|---|---|
| 4,681,425 | A * | 7/1987 | Tanimoto | 399/16 |
| 6,035,151 | A * | 3/2000 | Ono et al. | 399/43 |
| 7,266,339 | B2 * | 9/2007 | Fujiwara et al. | 399/406 |
| 8,339,657 | B2 * | 12/2012 | Yamazaki | 358/1.6 |
| 2007/0098431 | A1 * | 5/2007 | Sugiyama | 399/88 |
| 2007/0264033 | A1 * | 11/2007 | Koshida | 399/16 |
| 2008/0075478 | A1 * | 3/2008 | Kohara | 399/16 |

(Continued)

FOREIGN PATENT DOCUMENTS

| | | | |
|---|---|---|---|
| JP | 2000-118859 | A | 4/2000 |
| JP | 2000-162920 | A | 6/2000 |

(Continued)

OTHER PUBLICATIONS

Japanese Office Action dated Dec. 3, 2013 for corresponding Japanese Application No. 2010-047070.

*Primary Examiner* — Judy Nguyen
*Assistant Examiner* — Blake A Tankersley
(74) *Attorney, Agent, or Firm* — Harness, Dickey & Pierce, P.L.C.

(57) ABSTRACT

An image forming apparatus includes an image forming unit forming an image on a sheet transported along a transport path in a printing operation; a sheet stacking unit in which the sheet ejected at the end of the transport path is stacked; a sheet detecting unit detecting the presence or absence of the sheet in the transport path; a counting unit counting number-of-sheet data of the sheet detected by the sheet detecting unit; and a control unit controlling the printing operation in accordance with a first print request from a print instructing unit for a print job and based on a count value obtained by the counting unit. The control unit clears the count value in the absence of a next print request from the print instructing unit within a predetermined time after completion of the printing operation.

10 Claims, 10 Drawing Sheets

(56) References Cited

U.S. PATENT DOCUMENTS

| | | | | |
|---|---|---|---|---|
| 2008/0107437 | A1* | 5/2008 | Nishida | 399/70 |
| 2008/0219682 | A1* | 9/2008 | Yamasaki et al. | 399/16 |
| 2008/0273908 | A1 | 11/2008 | Ohkubo et al. | |
| 2008/0284090 | A1 | 11/2008 | Honda et al. | |
| 2008/0304836 | A1* | 12/2008 | Tamagaki | 399/21 |
| 2009/0110459 | A1 | 4/2009 | Honda et al. | |
| 2009/0224467 | A1 | 9/2009 | Mori | |
| 2009/0314837 | A1* | 12/2009 | Kataoka et al. | 235/385 |

FOREIGN PATENT DOCUMENTS

| | | | |
|---|---|---|---|
| JP | 2003137479 | A | 5/2003 |
| JP | 2006256826 | A | 9/2006 |
| JP | 2008230821 | A | 10/2008 |
| JP | 2008285279 | A | 11/2008 |
| JP | 2009-208899 | A | 9/2009 |

* cited by examiner

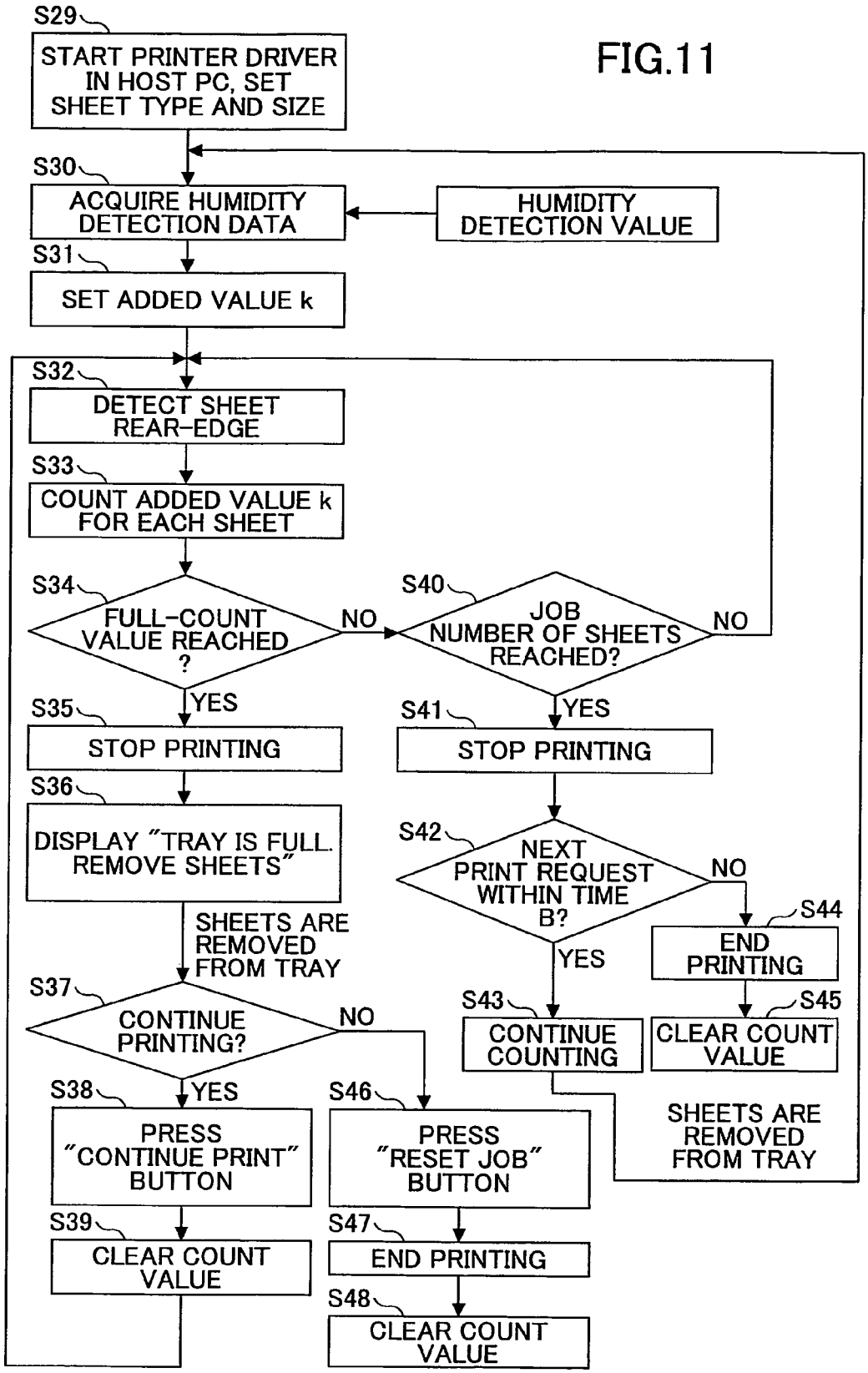
FIG.11
S29
START PRINTER DRIVER IN HOST PC, SET SHEET TYPE AND SIZE
S30
ACQUIRE HUMIDITY DETECTION DATA
HUMIDITY DETECTION VALUE
S31
SET ADDED VALUE k
S32
DETECT SHEET REAR-EDGE
S33
COUNT ADDED VALUE k FOR EACH SHEET
S34
FULL-COUNT VALUE REACHED ?
NO
YES
S35
STOP PRINTING
S36
DISPLAY "TRAY IS FULL. REMOVE SHEETS"
SHEETS ARE REMOVED FROM TRAY
S37
CONTINUE PRINTING?
NO
YES
S38
PRESS "CONTINUE PRINT" BUTTON
S39
CLEAR COUNT VALUE
S40
JOB NUMBER OF SHEETS REACHED?
NO
YES
S41
STOP PRINTING
S42
NEXT PRINT REQUEST WITHIN TIME B?
NO
YES
S44
END PRINTING
S45
CLEAR COUNT VALUE
S43
CONTINUE COUNTING
SHEETS ARE REMOVED FROM TRAY
S46
PRESS "RESET JOB" BUTTON
S47
END PRINTING
S48
CLEAR COUNT VALUE

IMAGE FORMING APPARATUS WHICH DETERMINES WHETHER A SHEET STACKING UNIT IS FULL

BACKGROUND OF THE INVENTION

1. Field of the Invention

The present invention generally relates to image forming apparatuses, such as copy machines, printers, and multifunction peripherals having multiple image forming functions such as printing and copying functions. Particularly, the present invention relates to an image forming apparatus having a sheet stacking unit.

2. Description of the Related Art

In an image forming apparatus, such as a small-sized printer or copy machine, a dedicated sheet-height sensor may be provided for detecting the height of sheets of recording material (recording medium) stacked in an ejected sheet tray. Based on a signal provided by the sheet-height sensor, the number of sheets ejected onto the sheet stacking unit is controlled in order to prevent stacking failure or the like, as discussed in Japanese Laid-Open Patent Publication No. 2003-137479 ("Patent Document 1") or Japanese Laid-Open Patent Publication No. 2008-230821 ("Patent Document 2"), for example.

Patent Document 1 discusses a full-status detection filler that includes a filler main body and an auxiliary filler. The filler main body and the auxiliary filler are fastened to each other by screws so that the length of the full-status detection filler can be adjusted depending on the property of the sheet material, such as paper. Patent Document 2 discusses a technology by which plural full-status detection fillers are disposed along a width direction of a sheet in accordance with the size of the sheet.

Japanese Laid-Open Patent Publication No. 2006-256826 ("Patent Document 3") discusses a technology that attempts to overcome the problem of stacking failure and the like in an image forming apparatus without using a dedicated sheet-height detecting unit. In this technology, a sheet-presence detecting unit provided in the image forming apparatus is used to count the number of sheets ejected onto the sheet stacking unit. The maximum number of sheets that can be stacked in the sheet stacking unit (which may be referred to as a "maximum load") is varied depending on the type of paper or its basis weight. Specifically, the technology involves setting an upper limit of the number of sheets ejected onto the sheet stacking unit depending on the type of sheet or a print ratio, so that the problem of tacking (where sheets at the bottom of the stack stick to each other) can be prevented.

There is an increasing demand for ever smaller image forming apparatuses. The size of an image forming apparatus may be decreased by decreasing the size of its image forming unit, which may include a process cartridge. However, the size of the image forming unit can be reduced only so much. Thus, there is a trend to focus on how to decrease the size of the sheet stacking unit (ejected sheet tray). However, the decrease in size of the sheet stacking unit naturally results in a decrease in the maximum number of printed sheets that can be stacked in the stacking unit. This means that the risk of stacking failure increases because the maximum load is reached sooner and therefore any excess stacked sheets may fall out of the sheet stacking unit more readily. While such stacking failure may be prevented by providing the sheet height detecting unit as discussed in Patent Document 1 or 2, the sheet height detecting unit leads to an increase in cost and requires additional space for installation.

In the case of Patent Document 3, the existing sheet-presence detecting unit disposed in the sheet transport path is used for counting the number of sheets actually stacked in the stacking unit in order to detect a full-status upon reaching the maximum load without requiring an additional sheet-height detecting unit. However, in the case of small-sized, consumer-oriented image forming apparatuses, the image forming apparatus is usually installed near an operator or a user. Typically, the user goes and picks up the printed sheet immediately after printing partly because such a small-sized printer is not usually used for printing large numbers of sheets at one time.

If the above full-status detection method that counts the number of printed sheets is applied in a small-sized consumer-oriented image forming apparatus, the printing operation may be terminated or interrupted even when the maximum load is not yet reached, thereby adversely affecting the efficiency of the image forming apparatus.

Another problem of the related art is that a printed sheet may be curled in various ways and degrees after fusing, depending on the sheet characteristics and the water content of the sheet. For example, when a side curl develops, the position of the maximum height of the sheet may vary along the sheet width direction, depending on the sheet size. As a result, the maximum height of the sheet may not be accurately detected depending on the location of the sensor or the filler, thus causing stacking failure. While Patent Document 1 proposes adjusting a filler-contacting position depending on the property of the sheet, the shape and degree of a curl may vary over time depending on a moisture-absorbed condition of the sheet in response to a change in ambient humidity. Thus, the shape and degree of curl cannot be determined by the property of the sheet alone. While Patent Document 2 proposes installing the fillers along the sheet width direction to accommodate various sheet sizes, this results in an increase in size and cost of the apparatus and is therefore not suitable for consumer-oriented image forming apparatuses.

The technology discussed in Patent Document 3 attempts to prevent stacking failure without sheet height detection in the sheet stacking unit by utilizing the existing sheet-presence detecting unit to count the number of sheets ejected onto the sheet stacking unit. In this case, the maximum load may be controlled depending on the paper type or the sheet basis weight. While this technology may be capable of preventing stacking failure due to a height detection error, it is not capable of detecting the changes in the shape or degree of curling depending on the moisture-absorbed condition of the sheet, and is therefore not capable of adapting to changes in ambient humidity.

SUMMARY OF THE INVENTION

It is therefore a general object of the present invention to overcome the problems of the related art. A more specific object of the present invention may be to provide a small, low-cost, and user-friendly image forming apparatus capable of preventing stacking failure without using a dedicated sheet-height detecting unit. Another object of the present invention may be to control the number of sheets ejected and stacked in the sheet stacking unit by predicting the shape or degree of curl in the sheets by using a humidity detecting unit (humidity sensor) to indirectly detect the moisture-absorbed condition of the sheets.

In one aspect of the present invention, an image forming apparatus includes an image forming unit configured to form an image on a sheet in a printing operation; a transport unit configured to transport the sheet via a transport path; a sheet stacking unit configured to stack the sheet transported by the transport unit; a sheet detecting unit disposed in the transport path and configured to detect the presence or absence of the sheet in the transport path; a counting unit configured to count number-of-sheet data of the sheet detected by the sheet detecting unit; and a control unit configured to control the printing operation performed by the image forming unit and the transport unit in accordance with a first print request from a print instructing unit for a print job and based on a count value obtained by counting the number-of-sheet data by the counting unit. The control unit clears the count value in the absence of a next print request from the print instructing unit within a predetermined time after the printing operation associated with the first print job request is completed.

BRIEF DESCRIPTION OF THE DRAWINGS

FIG. 11 is a flowchart of a sheet full-status detection process according to Embodiment 2.

DETAILED DESCRIPTION. OF THE PREFERRED EMBODIMENTS

Embodiment 1

Figure 1:
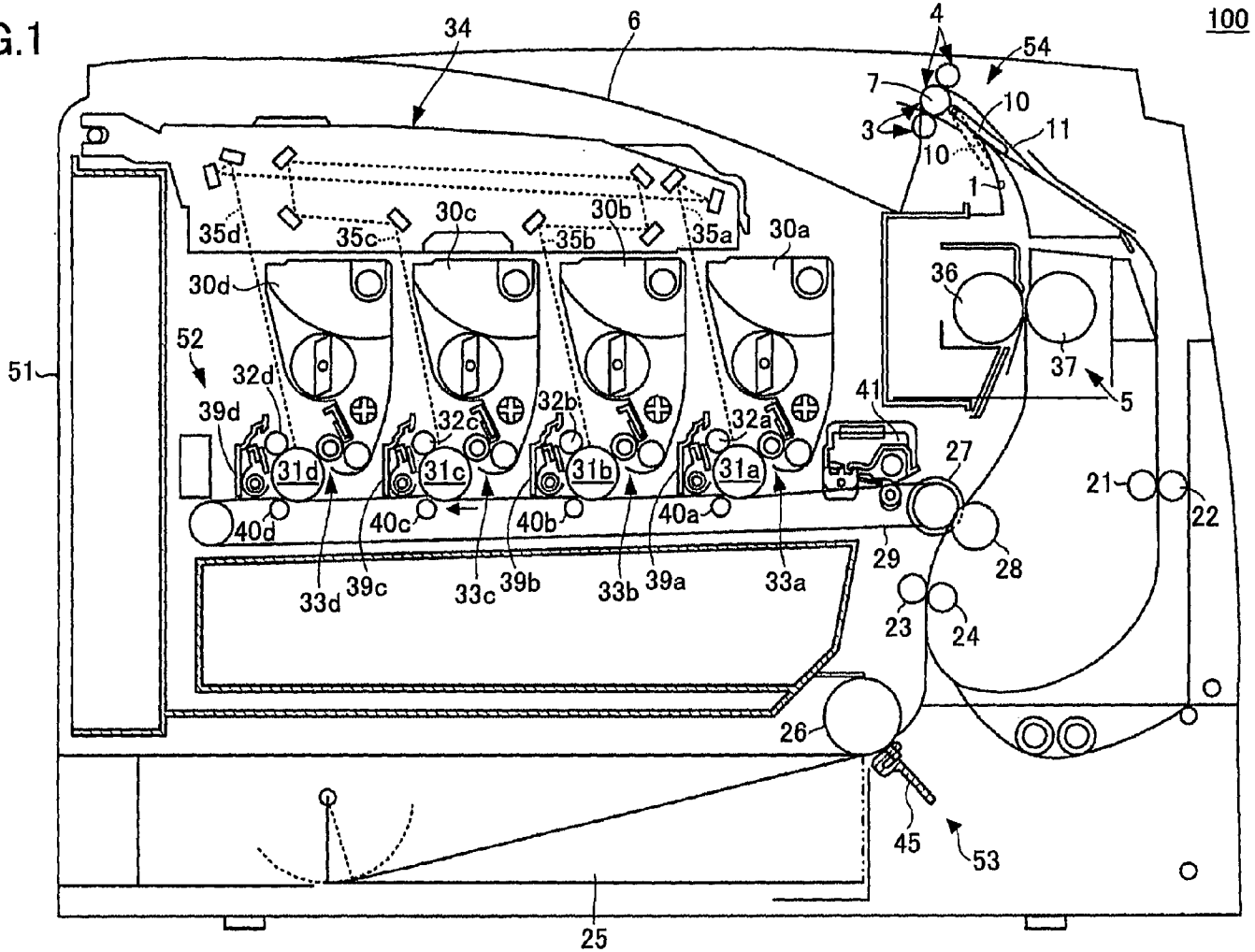
FIG. 1 illustrates an image forming apparatus according to an embodiment of the present invention.

FIG. 1 illustrates an image forming apparatus 100 according to an embodiment of the present invention. The image forming apparatus 100 is an example of a four-drum tandem color printer of an intermediate transfer type based on the principle of electrophotography. The image forming apparatus 100 may include a black-and-white printer, a copy machine, a facsimile machine, a plotter, an inkjet recording apparatus, or a multifunction peripheral.

The image forming apparatus 100 includes an image forming unit 52 that forms an image on a sheet S (recording medium). The sheet S is transported to the image forming unit 52 by a sheet-feeding unit 53 disposed under the image forming unit 52. The sheet S on which an image has been formed by the image forming unit 52 is eventually ejected onto an ejected sheet tray 6 (which may be referred to as a sheet stacking unit) disposed above the image forming unit 52 by a sheet-ejecting unit 54.

The image forming unit 52 includes four photosensitive drums 31*a*, 31*b*, 31*c*, and 31*d* which may be referred to as "photosensitive bodies" or "image carriers". Toner images of different colors are formed on the photosensitive drums 31*a* through 31*d* during an image forming process. In the illustrated example, yellow, cyan, magenta, and black toner images are formed on the surfaces of the photosensitive drums 31*a*, 31*b*, 31*c*, and 31*d*, respectively. The photosensitive drums 31*a* through 31*d* may be disposed in parallel at predetermined intervals along a sheet transport direction.

Under the photosensitive drums 31*a* through 31*d*, there is disposed an intermediate transfer belt 29 (intermediate transfer body). The intermediate transfer belt 29 is an endless belt extended across plural support rollers and rotated in a direction indicated by an arrow (in anticlockwise direction in FIG. 1). The intermediate transfer body may include an intermediate transfer drum instead of the endless belt.

The photosensitive drums 31*a* through 31*d* have similar units disposed around them. Thus, a photosensitive body unit 33*a* that includes the photosensitive drum 31*a* for the yellow toner image is described in the following as representing the photosensitive body units 33*a*, 33*b*, 33*c*, and 33*d*.

The photosensitive body unit 33*a*, which may be referred to as a "process cartridge", is detachable from the apparatus main body 51. The photosensitive body unit 33*a* includes a charging roller 32*a* that charges the surface of the photosensitive drum 31*a* uniformly; an exposed portion via which the photosensitive drum 31*a* is irradiated with laser light 35*a* from an exposing unit 34; a developing unit 30*a* that contains yellow toner (developer) for making visible an electrostatic latent image formed on the surface of the photosensitive drum 31*a* by the laser light 35*a*; and a cleaning unit 39*a* that removes and collects the toner that may remain on the surface of the photosensitive drum 31*a* after the developed image is transferred onto the intermediate transfer belt 29. A primary transfer roller 40*a* is disposed opposite the photosensitive drum 31*a* via the intermediate transfer belt 29.

When an image forming process is performed in the image forming apparatus 100, the surface of the photosensitive drum 31*a*, for example, is uniformly charged with a predetermined polarity by the charging roller 32*a* while the photosensitive drum 31*a* is rotated in a clockwise direction in FIG. 1. The charged surface of the photosensitive drum 31*a* is then irradiated with the laser light 35*a* from the exposing unit 34, whereby an electrostatic latent image is formed on the photosensitive drum 31*a*. The electrostatic latent image is then made visible as a yellow toner image by the developing unit 30*a*. The yellow toner image is thereafter transferred by the primary transfer roller 40*a* onto the intermediate transfer belt 29.

In a full-color image forming operation, the above image forming operation is similarly performed with respect to the photosensitive drums 31*b*, 31*c*, and 31*d*. Thus, the resultant yellow, cyan, magenta, and black toner images on the photosensitive drums 31*a* through 31*d* are successively transferred onto the intermediate transfer belt 29, forming a color-toner image. The intermediate transfer belt 29 is supported and rotated by a transfer drive roller 27. Opposite the transfer drive roller 27, a secondary transfer roller 28 is disposed via the transfer belt 29.

The sheet-feeding unit 53 includes a sheet feeding cassette 25 (sheet storing unit) for storing the sheets S, which may include transfer paper and resin films or sheets, for example. The sheet-feeding unit 53 also includes a sheet-feeding roller 26 for feeding the sheets S from the sheet feeding cassette 25, and a separating unit 45 for separating the sheets from each other. The separating unit may include a friction pad.

The sheet S fed from the sheet-feeding unit 53 is transported into a gap between a pair of registration rollers 23 and 24. When the front edge of the sheet S abuts the stationary registration rollers 23 and 24, any skew or misalignment at the front edge of the sheet S is corrected. The registration rollers 23 and 24 are configured to resume their rotation at a predetermined timing such that the color toner image formed on the intermediate transfer belt 29 can be aligned with the front edge of the sheet S in a secondary transfer area where the secondary transfer roller 28 is provided. In the secondary transfer area, the color toner image is transferred onto the sheet S.

The sheet S is then transported to the fusing unit 5 where the color toner image is fused onto the sheet S by heat and pressure provided by the fusing unit 5. The fusing unit 5 includes a fusing roller 36 and a pressure roller 37. The sheet S is thereafter ejected onto the ejected sheet tray 6 by a pair of sheet-ejecting rollers 3 in the sheet-ejecting unit 54. This completes a single-sided color printing operation. Any toner that may remain on the surface of the intermediate transfer belt 29 after the color toner image transfer process is removed by the belt cleaning unit 41. The fusing roller 36 and the pressure roller 37 also function as transport units for transporting the sheet S.

Figure 2:
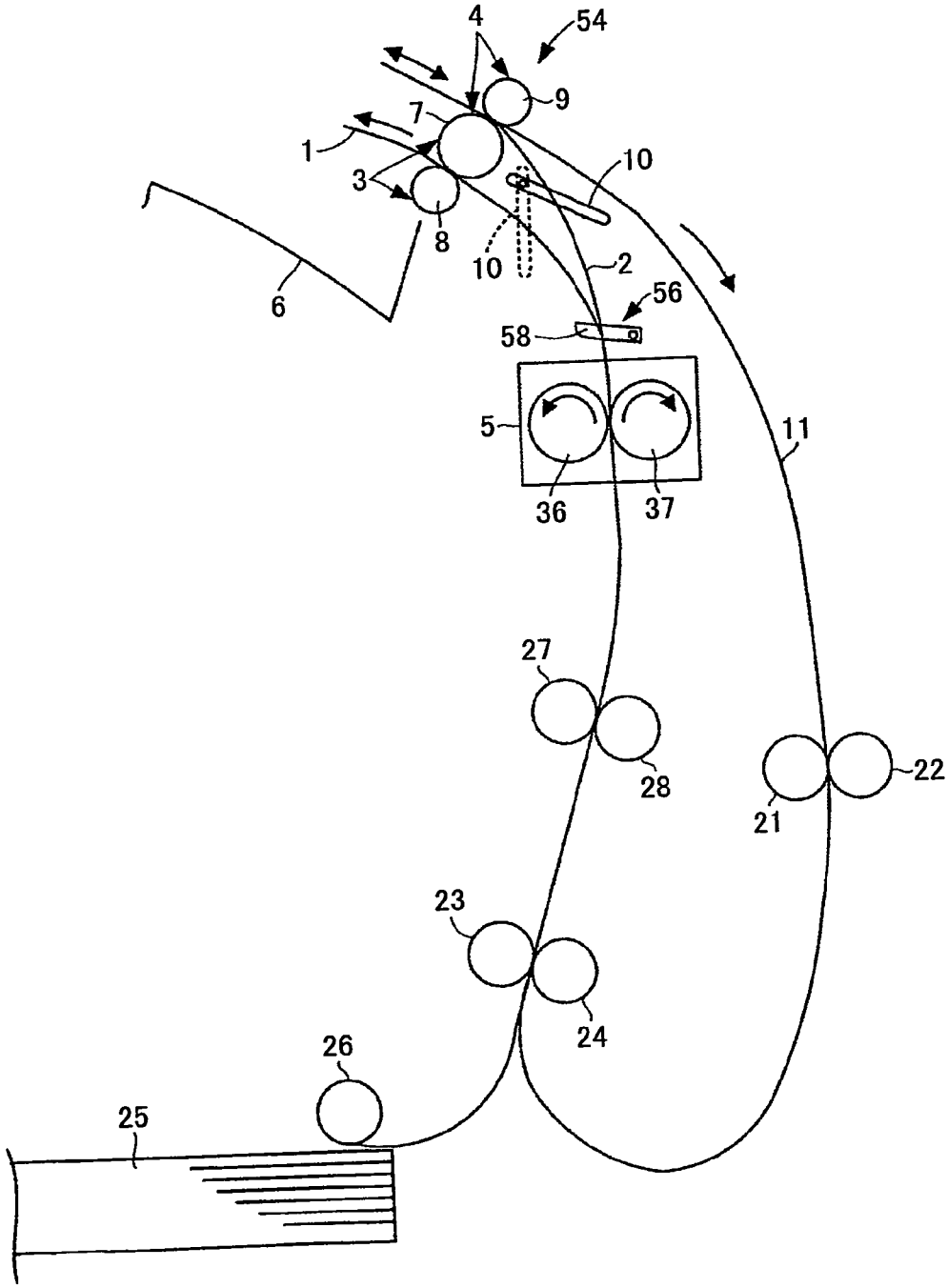
FIG. 2 illustrates transport paths for single-sided printing and double-sided printing.

Referring to FIGS. 1 and 2, the image forming apparatus 100 has a sheet transport path between the sheet feeding cassette 25 and the ejected sheet tray 6. The sheet transport path includes a common transport path that branches out to a first sheet transport path 1 and a second sheet transport path 2. The first sheet transport path 1 has a first curvature and is configured to guide the fused sheet S. The second sheet transport path 2 has a second curvature smaller than the first curvature and is also configured to guide the fused sheet S. The first and second sheet transport paths 1 and 2 are switched by a switching guide 10. The fused sheet S is eventually ejected onto the ejected sheet tray 6 by the sheet ejecting unit 54.

The transport path also includes a double-sided transport path 11, which is a third sheet transport path configured to guide the fused sheet S after its transport direction is inverted back to the image forming unit 52 (photosensitive units 33*a* through 33*d*) for forming an image on the other side of the fused sheet S for doubledsided printing. In the common transport path, a sheet detecting unit 56 is provided near an exit of the fusing unit 5. The sheet detecting unit 56 detects the presence or absence of the transported sheet.

As illustrated in FIG. 2, the sheet-ejecting unit 54 includes an inverting mechanism including a sheet-ejecting roller 7 configured to be rotated in either direction. The sheet-ejecting roller 7 is engaged with a first sheet-ejecting driven roller 8 and a second sheet-ejecting driven roller 9. Thus, the first and second sheet-ejecting driven rollers 8 and 9 can be rotated by the sheet-ejecting roller 7. The sheet-ejecting unit 54 also includes a switching guide 10 disposed upstream of the sheet-ejecting roller 7 that is configured to select the first sheet transport path 1 or 2. The switching guide 10 may include a drive mechanism including a drive unit, such as a solenoid, and a biasing unit, such as a spring, both not shown. The sheet ejecting unit 54 may be similar to a sheet-ejecting device discussed in Japanese Laid-open Patent Publication No. 2008-285279, for example. The first and second sheet transport paths 1 and 2 and the double-sided transport path 11 may be at least partially formed by guide members, as will be described later. A pair of transport rollers 21 and 22 may be disposed at an intermediate position along the double-sided transport path 11.

The image forming apparatus 100 has a single-sided printing mode, a double-sided printing mode, and a curl reducing mode. Any of these modes may be selected in response to a print job instruction sent from a computer for each print job, as will be described later.

Figure 3:
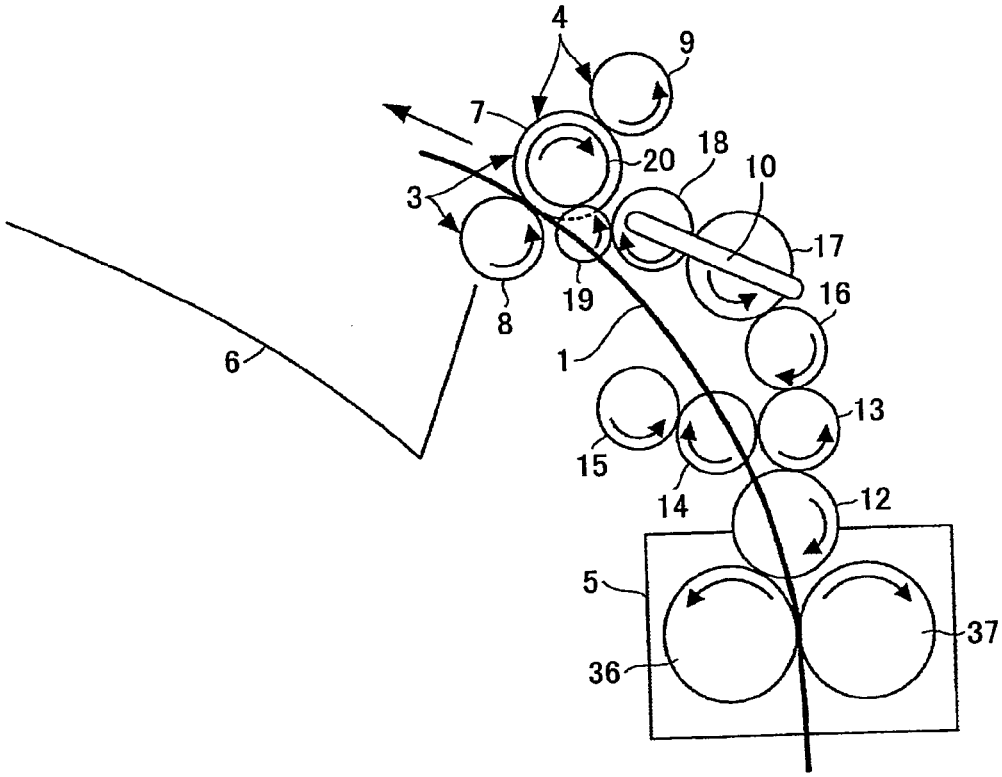
FIG. 3 illustrates a transport path and a drive mechanism for single-sided printing.

FIG. 3 illustrates the first sheet transport path 1, which is used for the single-sided print mode. As illustrated, during a single-sided printing operation, the switching guide 10 is moved in a direction such that the sheet S can be guided onto the first sheet transport path 1. In this case, the sheet S is ejected onto the ejected sheet tray 6 via the first transport path 1 that passes via the sheet-ejecting roller pair 3, which includes the sheet-ejecting roller 7 and the first sheet-ejecting driven roller 8. In this case, the sheet-ejecting roller 7 is rotated in a direction of an arrow, i.e., in a clockwise direction in FIG. 3. The direction of rotation of the sheet-ejecting roller 7 in this case may be referred to as a "normal direction".

Figure 4A:
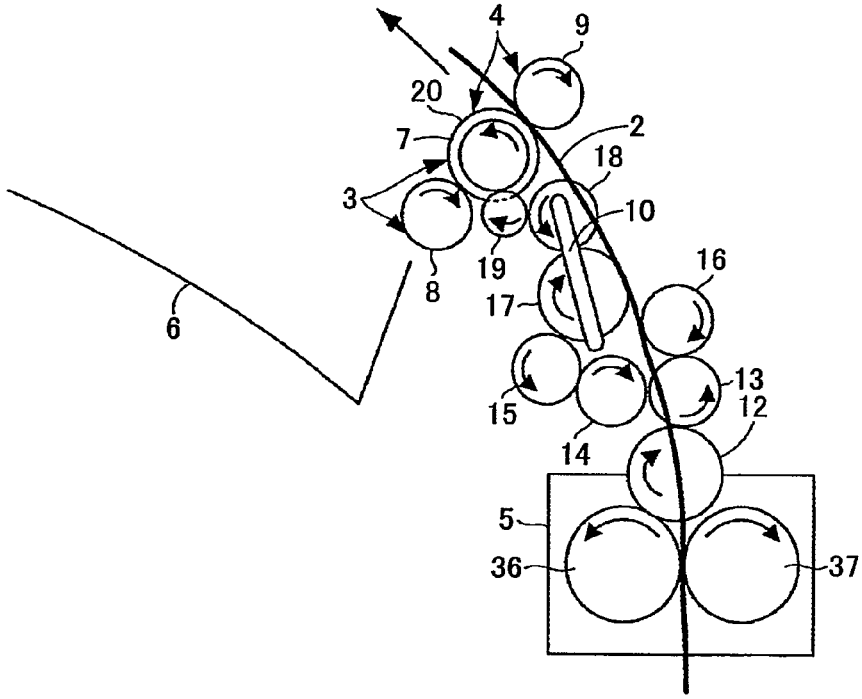
FIG. 4A illustrates a first state of the transport path and the drive mechanism during double-sided printing.

FIG. 4A illustrates the second sheet transport path 2, which is for the double-sided printing mode. The switching guide 10 is moved in a direction such that the sheet S can be guided onto the second sheet transport path 2. In this case, the sheet that is printed on one side only is transported in the direction of the ejected sheet tray 6 via the sheet-ejecting roller pair 4, which includes the sheet-ejecting roller 7 and the second sheet-ejecting driven roller 9. The sheet-ejecting roller 7 is rotated in a direction indicated by an arrow which may be referred to as an "inverting direction". The state illustrated in FIG. 4A may be referred to as a "first state".

Figure 4B:
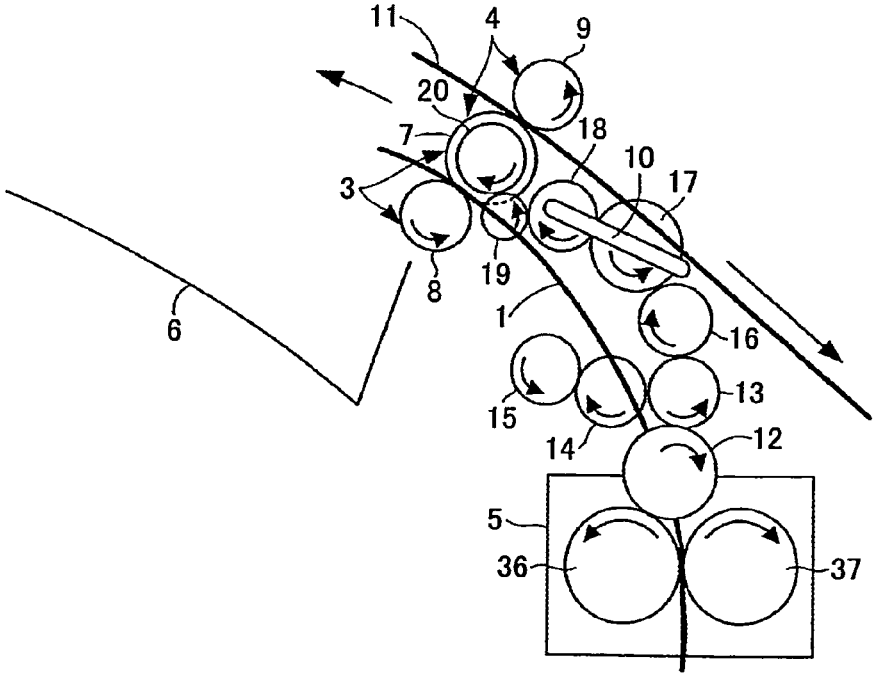
FIG. 4B illustrates a second state of the the transport path and the drive mechanism during double-sided printing.

Referring to FIG. 4B, the switching guide 10 is switched in a direction such that the sheet S can be guided onto the double-sided transport path 11. At the same time, the sheet-ejecting roller 7 is rotated in the normal (clockwise) direction. Thus, the transport direction of the sheet S in the second sheet transport path 2 is inverted, so that the sheet S is guided onto the double-sided transport path 11 for a double-sided printing operation, while the next sheet that has been printed on both sides may be transported along the first sheet transport path 1 and ejected onto the ejected sheet tray 6 by the sheet-ejecting roller pair 3. The state illustrated in FIG. 4B may be referred to as a "second state".

Thus, in the image forming apparatus 100 according to the present embodiment or in the image forming apparatus of Japanese Laid-open Patent Publication No. 2008-285279, when normal sheets of paper having a low sheet rigidity (excluding envelopes or other special-purpose sheets, such as application papers) are used, a double-sided printing operation can be performed by repeating the first state of FIG. 4A and the second state of FIG. 4B.

With reference to FIGS. 3 and 4, an inversion drive mechanism is described. As illustrated, near the fusing roller 36, there is disposed a fusing gear 12 to which a drive force is transmitted from a drive source (not shown) for driving the fusing roller 36. The fusing gear 12 is configured to rotate only in one direction (clockwise direction in the illustrated example). There are two drive force transmission paths from the fusing gear 12. One drive force transmission path includes gears 13, 14, and 15. The other drive force transmission path includes the gear 13 and a gear 16. The additional intermediate gear in the one drive force transmission path causes the final gears 15 and 16 of the respective drive force transmission paths to have opposite rotating directions.

The switching guide 10 is supported by swing gears 17 and 18 via links (not shown) such that the switching guide 10 can be rotated toward the first sheet transport path 1 or the second sheet transport path 2 by a drive source (not shown). When the sheet transport paths are switched, rotating direction of the swing gear 17 attached to the switching guide 10 is also switched. As a result, the rotating direction of the sheet-ejecting roller 7, to which the drive force is transmitted from the fusing gear 12 via the gears 18, 19, and 20, is reversed. The swing gear 17 may be rotated by a mechanism according to the aforementioned Japanese Laid-open Patent Publication No. 2008-285279 including a switch link, a transmitting link, and a solenoid.

The sheet transport operation during the double-sided printing is described in detail. In the second state of FIG. 4B, the sheet transported back on the double-sided transport path 11 for a double-sided printing is further transported to the position of the registration rollers 23 and 24 by the transport rollers 21 and 22 illustrated in FIG. 2. Thereafter, in the same transport path as that for the single-sided printing operation illustrated in FIG. 3, a toner image is formed on the back side of the sheet that has been printed on one side. The back-side toner image is then fused by the fusing unit 5, and the sheet is, eventually ejected onto the ejected-sheet tray 6, thus completing the double-sided printing process.

Figure 5A:
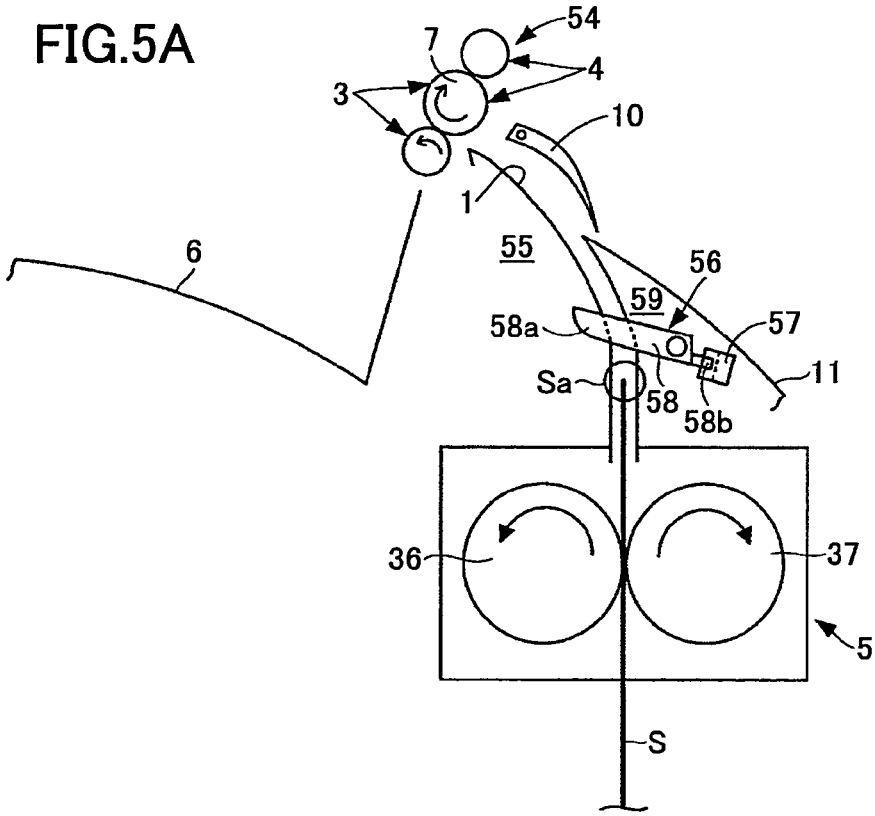
FIGS. 5A and 5B illustrate a structure and operation of an ejected-sheet sensor.
Figure 5B:
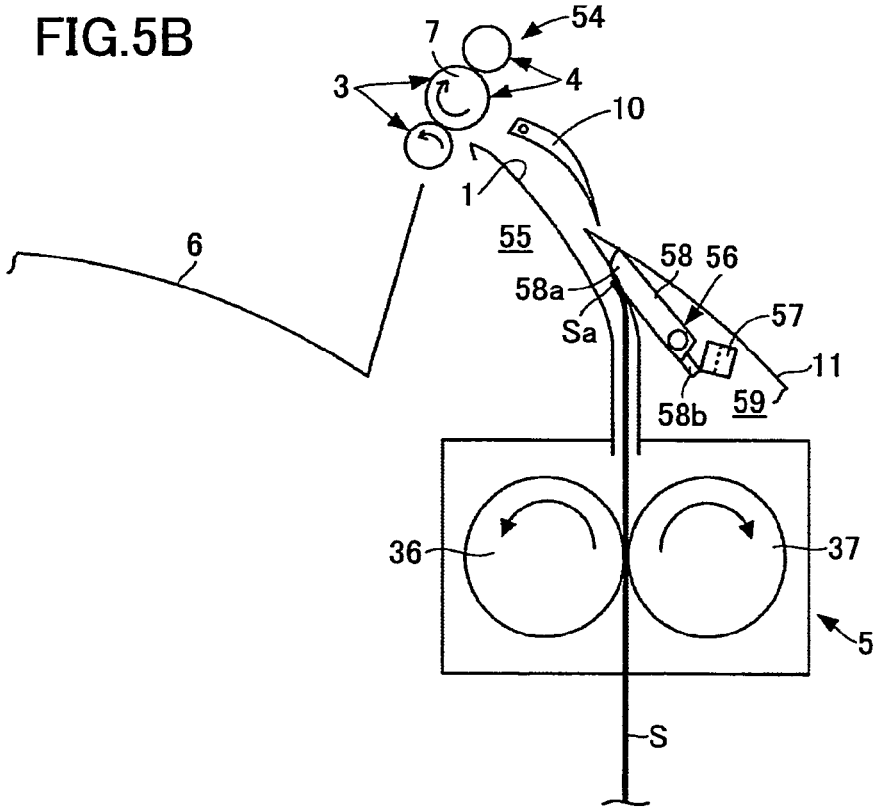
Figure 6:
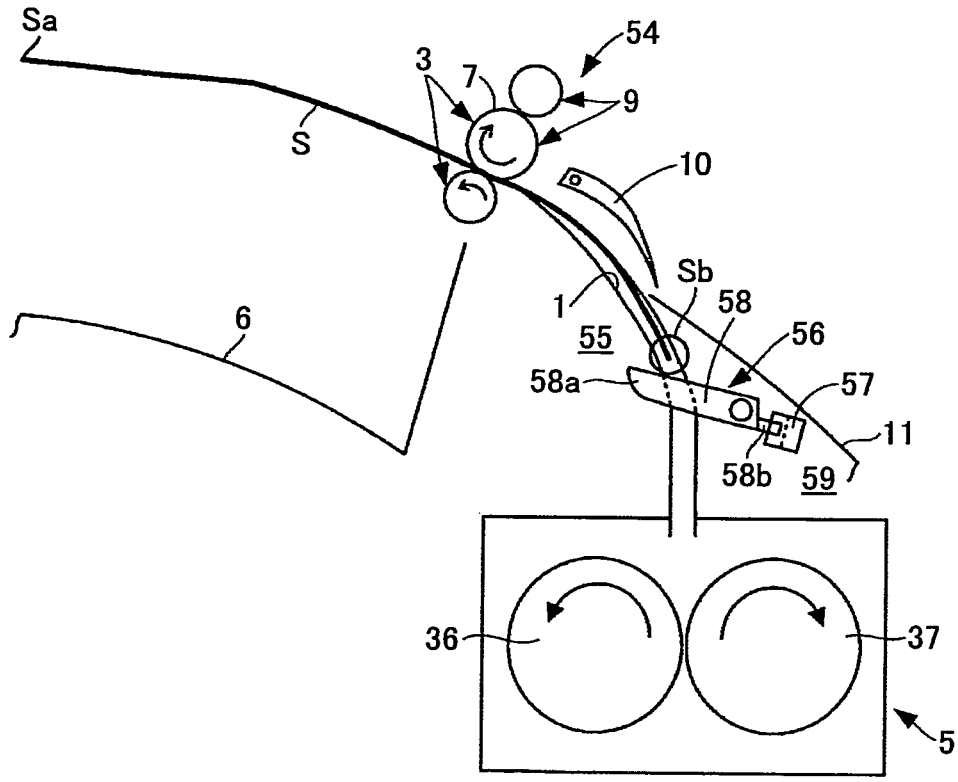
FIG. 6 illustrates an operation of the ejected-sheet sensor when the sheet has passed the ejected-sheet sensor.

With reference to FIGS. 5A and 5B and 6, the first and second sheet transport paths 1 and 2, the sheet detecting unit 56, and sheet transport operations will be described. The first sheet transport path 1 is formed between an area defined by guide member 55 and guide member 59 at the end of the common transport path and the sheet-ejecting roller pair 3. The second sheet transport path 2 is formed between the end of the common transport path and the sheet-ejecting roller pair 4. The double-sided transport path 11 is formed between the sheet-ejecting roller pair 4 and an area defined by an outer surface of the guide member 59 (to the right in FIG. 5A) and a guide member (not shown) disposed opposite the outer surface of the guide member 59 to the right in FIG. 5A, for example.

The sheet detecting unit 56 includes an ejected-sheet sensor 57, such as a transmitting-type photosensor and an ejected-sheet detecting filler 58. The ejected-sheet detecting filler 58 is configured to rotate upon contact with the sheet S transported on the common transport path. The ejected-sheet detecting filler 58 includes a contact portion 58*a* on one end that contacts the sheet S, and a light-blocking portion 58*b* on the other end that blocks an optical path of the ejected-sheet sensor 57. The ejected-sheet detecting filler 58 is rotatably supported by the guide member 59. The contact portion 58*a* of the ejected-sheet detecting filler 58 is weakly biased at all times by a biasing unit, such as a torsion spring (not shown), such that the ejected-sheet detecting filler 58 is normally positioned as illustrated in FIG. 5A. The movement of the ejected-sheet detecting filler 58 may be regulated by a stopper member (not shown) such that the ejected-sheet detecting filler 58 does not rotate further than the illustrated position in anticlockwise direction during a printing operation.

An operation of the sheet detecting unit 56 is briefly described. In the single-sided printing operation, the sheet S is transported by the rotation of the fusing roller 36 and the pressure roller 37 in the fusing unit 5. Before a front edge Sa (shown encircled) of the sheet S reaches the ejected-sheet detecting filler 58, as illustrated in FIG. 5A, the ejected-sheet detecting filler 58 is positioned to block the common transport path. In this case, the optical path of the ejected-sheet sensor 57 is blocked by the light-blocking portion 58*b* of the ejected-sheet detecting filler 58, so that the ejected-sheet sensor 57 outputs an off-detection signal.

As the sheet front edge Sa reaches the ejected-sheet detecting filler 58, the contact portion 58*a* of the ejected-sheet detecting filler 58 is pushed and rotated by the sheet S in a clockwise direction, as illustrated in FIG. 5B. At this time, the light-blocking portion 58*b* of the ejected-sheet detecting filler 58 is moved out of the optical path of the ejected-sheet sensor 57, so that the ejected-sheet sensor 57 outputs an on-detection signal.

Referring to FIG. 6, after a rear-edge Sb (shown encircled) of the sheet S passes the ejected-sheet detecting filler 58, the contact portion 58*a* of the ejected-sheet detecting filler 58 is returned to the normal position blocking the common transport path. At this time, as in the case of FIG. 5A, the optical path of the ejected-sheet sensor 57 is blocked by the light-blocking portion 58*b* of the ejected-sheet detecting filler 58. Thus, the ejected-sheet sensor 57 outputs the off-detection signal. Thereafter, the sheet S is ejected onto the ejected sheet tray 6 via the sheet-ejecting roller pair 3. The "off-on-off" sequence of the electric signals from the ejected-sheet sensor 57 (photodetector) corresponding to the rotation of the ejected-sheet detecting filler 58 provides information about the presence or absence of the sheet for the printing and sheet-ejecting operations. The information may include number-of-sheet data of the sheet S ejected and stacked in the ejected sheet tray 6.

In the double-sided printing operation, the sheet S is passed through the common transport path twice. Thus, two of the "off-on-off" sequences of the electric signals provided by the ejected-sheet sensor 57 provide the number-of-sheet data for the sheet S ejected and stacked in the ejected sheet tray 6 in the case of the double-sided printing operation.

Figure 7:
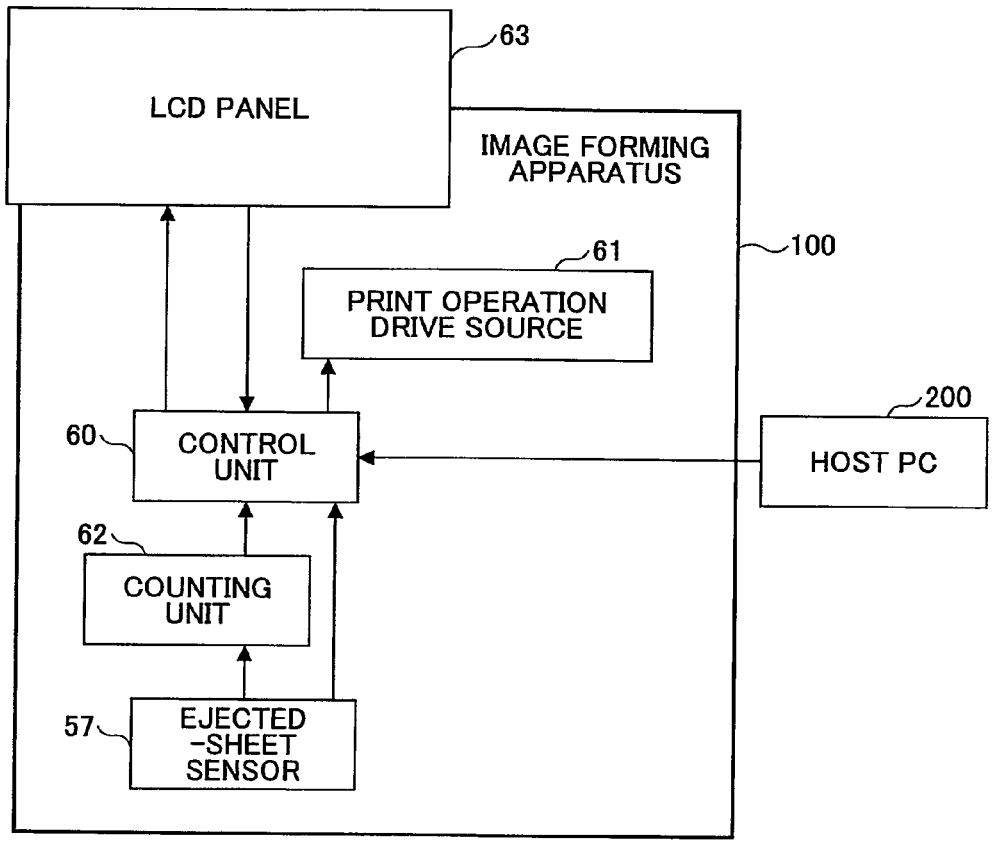
FIG. 7 is a block diagram of a control system according to Embodiment 1.

FIG. 7 is a block diagram of the image forming apparatus 100 illustrating its control system. In accordance with the present embodiment, the image forming apparatus 100 is connected to a host personal computer (PC) 200. The host PC 200 sends a print request instruction to a control unit 60. Thus, the host PC 200 may function as a print instructing unit that provides a print job instruction to the various units of the image forming apparatus 100, such as the image forming unit 52 and the transport units.

The host PC 200 includes a printer driver (not shown). The printer driver may be configured to display a setting screen and selecting buttons (not shown) for setting the single-sided printing mode, the double-sided printing mode, or a curl reducing mode, as well as various print conditions (such as the number of prints, paper type, and sheet size). Thus, a user may select or set any of the modes or print conditions by operating the printer driver, for example, by moving a cursor or clicking on the setting screen using a mouse, or pressing a short-cut key designating a combination of some of the keys on a keyboard. An instruction regarding the mode or print conditions selected by the above operation is then transmitted from the host PC 200 to the control unit 60.

The control unit 60 controls a printing operation drive source 61 that may include motors and solenoids provided in various units such as the image forming unit 52 and the transport units. The control unit 60 also controls the printing operation based on the detection of a sheet position by an ejected-sheet sensor 57. The number-of-sheet data associated with the number of on- or off-states detected by the ejected-sheet sensor 57 may be counted by a counting unit 62 to provide a count value. The control unit 60 notifies the user about a print status (such as an error status) by sending a signal to an LCD panel 63. The user may operate the LCD panel 63 so as to send a signal to the control unit 60 to clear the error status. Thus, the control unit 60, based on a print request for a print job from the host PC 200 and the count value of the number-of-sheet data provided by the counting unit 62, controls the printing operation involving the image forming unit 52 and the transport units.

For example, in the double-sided printing mode, the control unit 60 recognizes that one sheet S has been ejected and stacked in the ejected sheet tray 6 based on the detection of the two "off-on-off" sequences by the ejected-sheet sensor 57. Namely, in this case, the control unit 60 determines that one half of the number-of-sheet data (off-on-off sequences) counted by the counting unit 62 corresponds to the number of sheets S ejected and stacked in the ejected sheet tray 6. Alternatively, the counting unit 62 may not be employed; instead, an operating function of a CPU in the control unit 60 may be used for counting the number-of-sheet data inputted from the ejected-sheet sensor 57 for each sheet, in cooperation with a RAM, for example.

Figure 9:
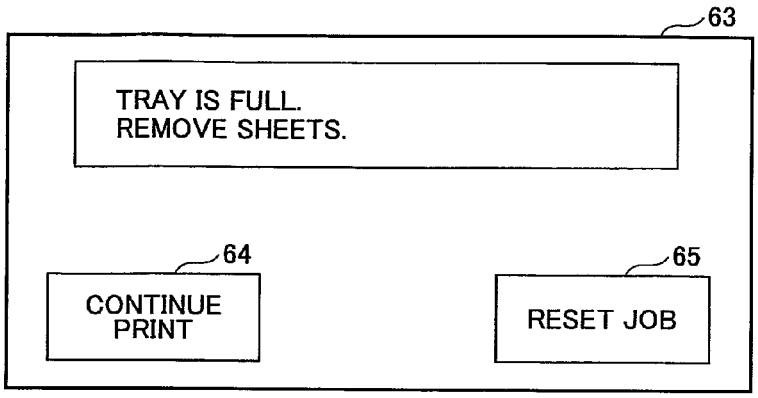
FIG. 9 is a plan view of a LCD panel of the image forming apparatus.

FIG. 9 illustrates an example of the LCD panel 63, which may include a touch panel. The LCD panel 63 is displaying an alert message ("TRAY IS FULL. REMOVE SHEETS"), a print continuation button 64, and a job reset button 65. By displaying the alert message, the LCD panel 63 functions as a notifying unit for notifying the user that the ejected sheet tray 6 is full. The print continuation button 64 is pressed when the user wishes to continue the printing operation.

The control unit 60 may include a CPU, a ROM, a RAM, and a timer. The control unit 60 may control the printing operation drive source 61 and the LCD panel 63 based on instructions from the host PC 200 and detection signals from various sensors and the count value from the counting unit 62, in accordance with an operating program called from the ROM. The sensors may include the ejected-sheet sensor 57, a sheet jam sensor for detecting a sheet jam, a door open/close sensor, and an expendable item sensor for detecting the need for replacement of a component.

The ROM may store relationship data (such as Tables 1 through 4 described below) in addition to the operating program (corresponding to the flowchart of FIG. 8, for example) for the printing operation drive source 61. The operating program or the relationship data may be called by the CPU as needed. The RAM may store a result of calculation by the CPU; data signals entered via the keys (such as print continuation button 64 and job reset button 65) on the LCD panel 63 or from the sensors, such as the ejected-sheet sensor 57; and the count value from the counting unit 62.

Figure 8:
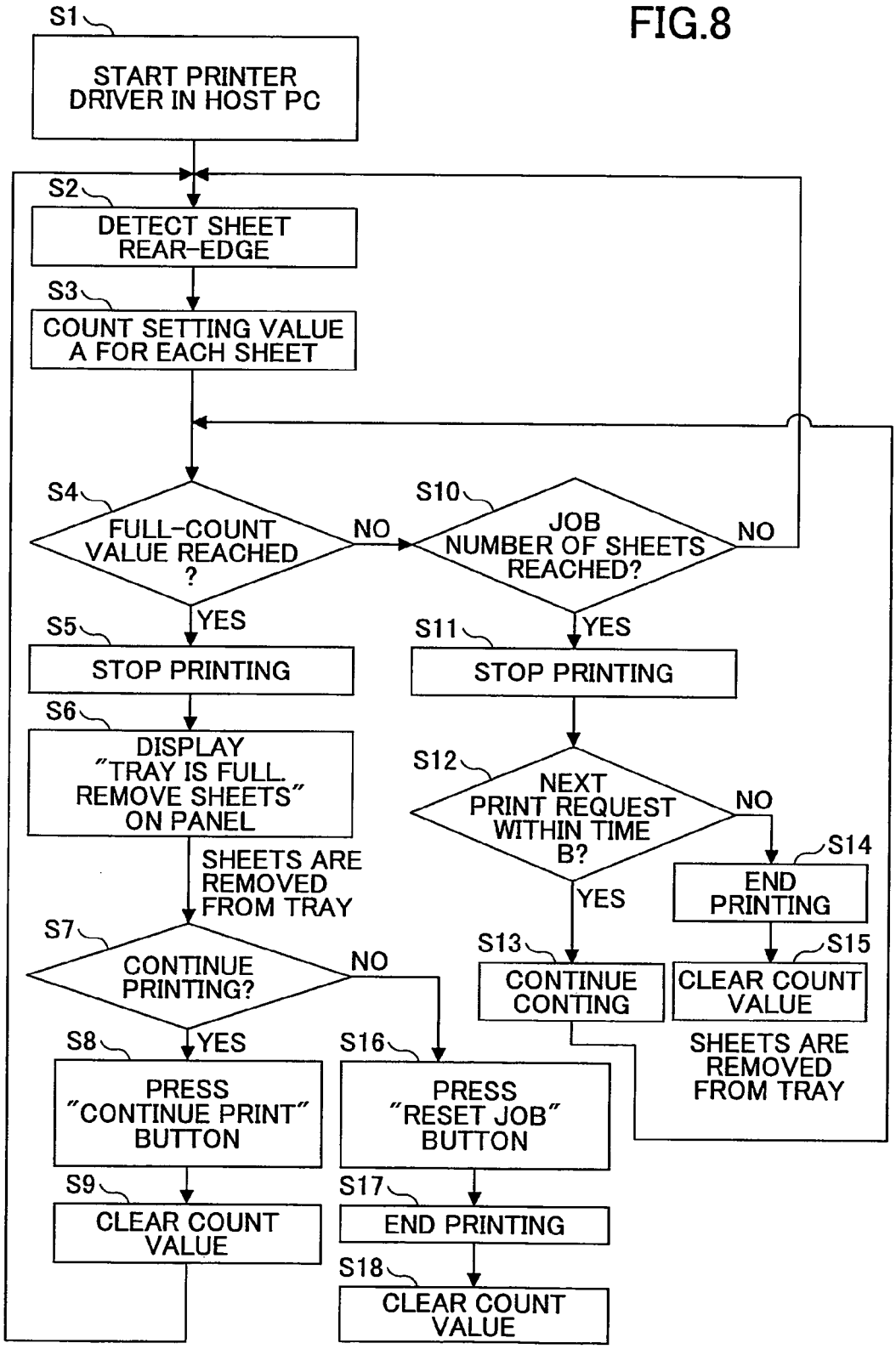
FIG. 8 is a flowchart of a sheet full-status detection process according to Embodiment 1.

With reference to the flowchart of FIG. 8, a process of detecting the full status (maximum load) of the ejected sheet tray 6 using the ejected-sheet sensor 57 is described. A full-count value corresponding to the maximum load of the ejected sheet tray 6 may be set to "150" in advance and stored in the ROM of the control unit 60. The full-status detecting process according to the present embodiment may be applied for either the single-sided mode or the double-sided printing mode. A print instruction or request for a print job from the host PC 200 is assumed to involve either single-sided or double-sided printing and not both at the same time. The characteristics of the sheets that can be used for double-sided printing in the image forming apparatus 100 may be limited to a basis weight of up to 90 g/m$^2$, as shown in Table 3.

In step S1, the printer driver in the host PC 200 is started up for a printing operation. In step S2, the rear-edge of a sheet being transported is detected by the ejected-sheet sensor 57. In step S3, the counting unit 62 (see FIG. 7) counts (accumulates) a setting value A for each sheet. In step S4, it is determined whether the full-count value has been reached by the sum of the setting values A. If the full-count value is reached, the printing operation is terminated in step S5. Then, in step S6, the LCD panel 63 displays the error message "TRAY IS FULL. REMOVE SHEETS", as illustrated in FIG. 9. In this case, the user normally follows the error message and removes the sheets from the ejected sheet tray 6.

After the sheets have been removed from the ejected sheet tray 6, the user may want to continue the printing operation. Thus, it is determined in step S7 whether the printing operation is to be continued. If the printing operation is to be continued, the print continuation button 64 on the LCD panel 63 is pressed in step S8, the count value of the counting unit 62 is cleared in step S9, and the routine returns to step 2. On the other hand, if the printing operation is not to be continued, the job reset button 65 on the LCD panel 63 is pressed in step S16, the printing operation is terminated in step S17, and the count value of the counting unit 62 is cleared in step S18.

The print job may be completed before the full-count value is reached, such as in the case of a small-lot printing operation. Thus, until the full-count value is reached, it is determined in step S10 whether a predetermined number of job sheets required by the print job is reached. If the predetermined number of job sheets is reached, the printing operation is terminated in step S11, and then it is determined in step S12 whether a next print request has been received from the host PC 200 within a time B. If the next print request is received within the time B, counting is continued in step S13 and then the routine returns to step 4. If it is determined in step S12 that the next print request is not received from the host PC 200 within the time B, the printing operation is terminated in step S14 and the count value is cleared in step 15. Then, the user removes the sheets from the ejected sheet tray 6. If it is determined in step S10 that the predetermined number of job sheets is not reached, the routine returns to step 2.

The time B referenced in step S12 may be on the order of one or a few minutes, depending on the manner in which the image forming apparatus is normally used, for example. The time B may be varied as needed by a service engineer or the user by modifying the configuration of the control unit 60.

Typically, a small printer, such as the image forming apparatus 100 according to the present embodiment, is installed near the user and configured to print a relatively small number of sheets at one time. Thus, it may be assumed that, after completion of the printing operation in step S14, all of the sheets will be removed from the ejected sheet tray 6. For this reason, the count value is cleared in step 15. If the count value is not cleared in step S15 (i.e., counting is continued in step S14) when there is no sheets on the ejected sheet tray 6, the printing operation may be interrupted in step S5 and the error message may be displayed in step S6 when the ejected sheet tray 6 is not yet full, thus causing the user to perform a wasteful operation.

In accordance with the present embodiment, the count value may be cleared not just in steps S9, S15, or S18 but also in cases described in Table 1 below. For example, when a sheet jam occurs, the count value is cleared because it may be assumed that the user most probably will go to the image forming apparatus 100 immediately and remove the sheets from the ejected sheet tray 6 so as to implement a jam process for eliminating the jam before implementing the remaining print jobs. This also applies at the end of the printing operation, as mentioned above.

For the same reason, the count value is cleared upon replacing an expendable item, or notifying the user about an abnormality in the image forming apparatus 100. Specifically, in such cases, the control unit 60 clears the count value and, based on the signals from the various sensors (not shown in FIG. 7), controls the printing operation drive source 61 and the LCD panel 63.

The sensors may include the jam sensor for detecting sheet jam; the door open/close sensor for detecting the opening or closing of doors (open/close member) which may be disposed at a boundary between the common transport path and an intermediate portion of the double-sided transport path 11 for the sheet jam process (see FIG. 1); and the expendable item sensors for determining the timing of replacement of expendable items, such as the toner, the photosensitive drums 31*a* through 31*d*, and the sheets in the sheet feeding cassette 25.

TABLE 1

| | Count value may be cleared when: |
|---|---|
| (1) | There is sheet jam |
| (2) | Doors for sheet jam process are opened |
| (3) | An expendable item is replaced |
| (4) | An error that requires notification to user occurs |

The setting value A is described. The setting value A may be added to the count value by the counting unit 62 each time the sheet rear-edge Sb is detected by the ejected-sheet sensor 57. The setting value A may be varied depending on the type of sheet or the characteristics of the sheet (such as paper type, basis weight, or sheet size), as illustrated in Tables 2 through 4 below. The setting values A in Tables 2 through 4 may be determined by evaluating results of experiments conducted by using an actual small-sized image forming apparatus corresponding to the image forming apparatus 100 of FIG. 1. Specifically, the experiments may determine an ejected-sheet stacking property indicating how many sheets can be stacked on the ejected sheet tray 6, depending on the sheet type and sheet characteristics as parameters. The setting value A may be stored in the ROM of the control unit 60 in the form of a data table.

TABLE 2

| Setting value A (per sheet) | Full-detecting number of sheets (*) | Paper type | Basis weight ($g/m^2$) | Size |
|---|---|---|---|---|
| 1 | 150 | Thin | 60-65 | A4/LT |
| | | Normal | 66-74 | A4/LT |
| | | Intermediate | 75-90 | A4/LT |
| | | Recycled | 60-90 | A4/LT |

(*) When the full-count value is 150.

TABLE 3

| Setting value A (per sheet) | Full-detecting number of sheets (*) | Paper type | Basis weight ($g/m^2$) | Size |
|---|---|---|---|---|
| 1.5 | 100 | Thin | 60-65 | LG ≥B5 |
| | | Normal | 66-74 | LG ≥B5 |
| | | Intermediate | 75-90 | LG ≥B5 |
| | | Recycled | 60-90 | LG ≥B5 |
| | | Thick | 91-105 | A4/LT LG ≥B5 |

(*) When the full-count value is 150.

TABLE 4

| Setting value A (per sheet) | Full-detecting number of sheets (*) | Paper type |
|---|---|---|
| 3 | 50 | Envelope Postcard |

(*) When the full-count value is 150.

In Tables 2, 3, and 4, sheet size "LG" indicates legal size, and "A4/LT" indicates A4 or letter size.

The "full-detecting number of sheets" indicates the maximum number of sheets that can be actually stacked on the tray. For example, in the case of Table 3, the full-detecting number of sheets during a printing operation is obtained by dividing the full-count value (150) by the setting value A (1.5), which is 100 (sheets). The full-detecting number of sheets may be referred to as an "ejected-sheet stacking capacity".

Thus, as the setting value A increases, the full-detecting number of sheets decreases. Thus, when the sheets have a low stacking property ("stackability"), stacking failure can be prevented by reducing the full-detecting number of sheets, i.e., the number of sheets actually stacked in the tray, by increasing the setting value A. Thus, the setting value A may be regarded as being a kind of correction value for limiting the maximum load of the tray during a printing operation depending on the sheet stackability.

The curl reducing mode of the image forming apparatus 100 is described. In the curl reducing mode, the fusing roller 36 and the pressure roller 37 are pressed against each other and rotated idly before the sheet is passed between them when the sheet has a large curl and a significantly low stackability. Specifically, in the curl reducing mode, the fusing roller 36 and the pressure roller 37 are rotated idly while in pressure-contact with each other so that the temperature difference between them, which tends to increase the curl can be reduced or eliminated.

However, the curl of the sheet may not be sufficiently reduced or eliminated even when the curl reducing mode is activated, particularly when the curl is due to a sheet condition, such as the water content of the sheet. Thus, in order to more effectively prevent stacking failure, the setting value A may be increased, such as to a maximum value of "3" (corresponding to the full-detecting sheet number of 50) when the curl reducing mode is activated, regardless of the sheet characteristics (such as paper type, basis weight, or size).

As illustrated in Table 2, in accordance with the present embodiment, when the setting value A=1, the full-count value (maximum load) is normally 150. The control unit 60 may be configured such that the full-count value can be varied by the service engineer or user. This feature may be realized by, for example, providing a PROM (such as an EPROM, an EEPROM, or a flash memory) in addition to the ROM in the control unit 60 so that the setting value data can be rewritten by using a rewriting unit, such as a ROM writer.

Thus, in accordance with the present embodiment, the image forming apparatus 100 can provide the full-status detection function adapted to the particular manner in which a user uses the image forming apparatus 100, without increasing the size of the apparatus main body 51 or installing a dedicated full-status detection sensor.

Embodiment 2

Figure 10:
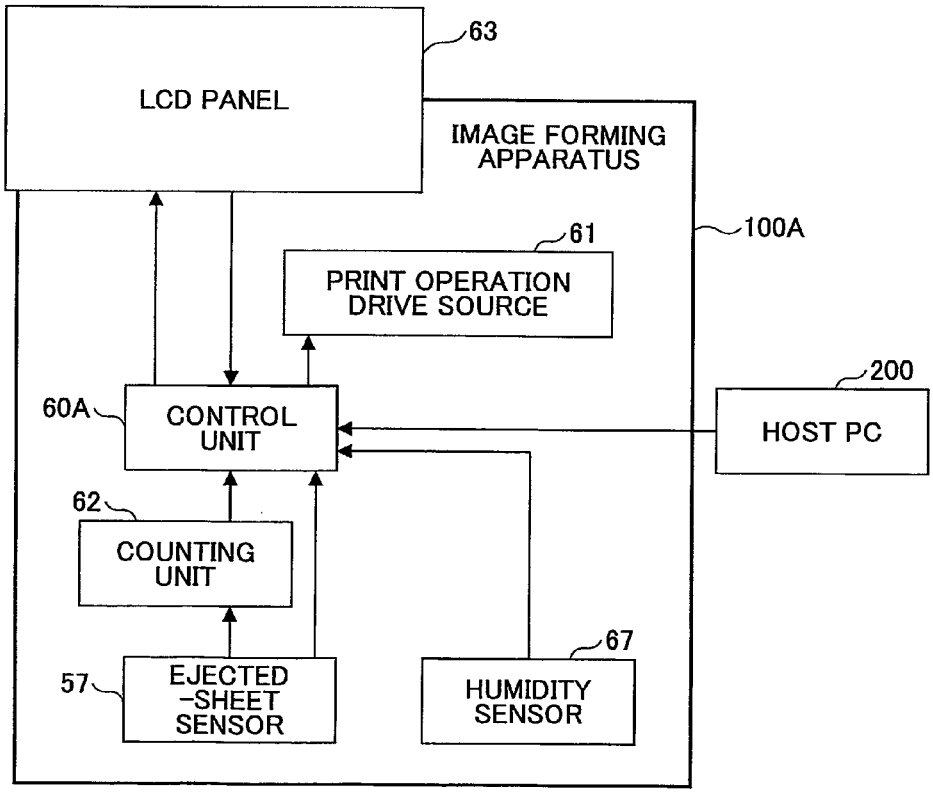
FIG. 10 is a block diagram of a control system according to Embodiment 2.

With reference to FIGS. 1 through 6 and FIGS. 9 through 11, an image forming apparatus 100A according to Embodiment 2 of the present invention is described. The image forming apparatus 100A differs from the image forming apparatus 100 illustrated in FIGS. 1 through 7 in that a humidity sensor 67 illustrated in FIG. 10 is additionally provided, and that the control unit 60 is replaced with a control unit 60A. In other respects, the image forming apparatus 100A may be similar to the image forming apparatus 100.

The humidity sensor 67 detects the humidity (relative humidity) around the image forming apparatus 100A. The humidity sensor 67 may include a humidity sensor well known in the art. The humidity sensor 67 may be disposed between a side portion of the apparatus main body 51 (to the left of FIG. 1) and a left-side end of the sheet feeding cassette 25 in order to indirectly detect the water content of the sheets stored in the sheet feeding cassette 25.

FIG. 10 is a block diagram of a control system of the image forming apparatus 100A. The control system mainly differs from that of the image forming apparatus 100 illustrated in FIG. 7 in that an added value k added to the count value for each sheet counted by the counting unit 62 or the full-count value is varied depending on humidity detection data provided by the humidity sensor 67 to the control unit 60A. The control unit 60A terminates the printing operation when the count value, which depends on the humidity detection data, reaches the full-count value.

The control unit 60A, in order to notify the user of a print status (such as an error status), sends a signal to the LCD panel 63. In accordance with the present embodiment, upon detection of an ejected sheet by the ejected-sheet sensor 57, the counting unit 62 counts (accumulates) the added value, obtaining a count value. When the count value reaches the full-count value (maximum load), the control unit 60A indicates an error.

With reference to a flowchart of FIG. 11, a full-status (maximum load) detection process using the ejected-sheet sensor 57 is described, focusing mainly on differences from Embodiment 1.

First, in step S29, a user starts up a printer driver in the host PC 200 in order to start a printing operation based on user settings with regard to paper type and sheet size, for example. In step S30, humidity detection data is acquired. Specifically, a humidity detection value sent from the humidity sensor 67 is A-D converted by an A/D converter (not shown) and then supplied to the control unit 60A as humidity detection data.

In step S31, the control unit 60A calls a data table (Table 5 described below) stored in the ROM, and then extracts and sets the added value k based on the paper type and sheet size data from the host PC 200 and the humidity detection data. The added value k is set in advance in the table in the ROM, in association with the paper type, sheet size, and the humidity detection data, which may be periodically detected by the humidity sensor 67. Alternatively, the added value k may be a constant while varying the full-count value in accordance with the paper type and sheet size data and the humidity data, as described later with reference to Table 6.

In step S32, the rear-edge of a transported sheet is detected by the ejected-sheet sensor 57. In step S33, the counting unit 62 adds the value k for each sheet that is transported. The process in steps S34 through S48 is similar to the process in steps S4 through S18 of Embodiment 1 illustrated in FIG. 8.

The process in steps S34 through S48 of FIG. 11 differs from the process in steps S4 through S18 of FIG. 8 in that if it is determined in step S42 that a next print request is made from the host PC 200 within a time B, the counting is continued after newly setting the added value k or the full-count value based on the paper type and sheet size settings made by the user.

As in the case of Embodiment 1, the count value is cleared in the event of jamming during the printing operation on the assumption that the ejected sheets will be removed from the ejected sheet tray 6 in such a case. The control unit 60A also clears the count value (steps S34 through S39) when the count value counted by the counting unit 62 reaches the full-count value (maximum load).

After the end of the printing operation initiated by the previous print job request from the host PC 200, the control unit 60A clears the count value unless there is a next print request from the host PC 200 within the time B (step S45).

The added value k and the full-count value (maximum load) are described with reference to Table 5 below. When the image forming apparatus 100A is used in a normal-humidity environment, the stacking capacity of the tray for a normal A4-size paper may be 150 sheets, as indicated in Table 5. This means that a stacking failure, such as incorrect collating or missing page, may occur when more than 150 sheets are stacked in the ejected sheet tray 6. For example, when the humidity detection data is less than 50% and in the case of a normal A4-size paper, when the added value k is 1 and the full-count value (maximum load) is set at 150, the stacking capacity of the tray is exceeded when more than 150 sheets are stacked in the ejected sheet tray, whereupon the control unit 60A indicates an error (see step S36).

TABLE 5

| Paper | | H < 50 | | | 50 ≤ H < 80 | | | H ≥ 80 | | |
|---|---|---|---|---|---|---|---|---|---|---|
| type | Size | F | k | C | F | k | C | F | k | C |
| Thin | A4/LT | 150 | 1 | 150 | 150 | 1 | 150 | 150 | 3 | 50 |
| (60- | LG | 150 | 1 | 150 | 150 | 1.5 | 100 | 150 | 3 | 50 |
| 65 g/m$^2$) | ≤B5 | 150 | 1 | 150 | 150 | 1.5 | 100 | 150 | 5 | 30 |
| Normal | A4/LT | 150 | 1 | 150 | 150 | 1 | 150 | 150 | 3 | 50 |
| (66- | LG | 150 | 1 | 150 | 150 | 1.5 | 100 | 150 | 3 | 50 |
| 74 g/m$^2$) | ≤B5 | 150 | 1 | 150 | 150 | 1.5 | 100 | 150 | 5 | 30 |
| Middle | A4/LT | 150 | 1 | 150 | 150 | 1 | 150 | 150 | 3 | 50 |
| (75- | LG | 150 | 1 | 150 | 150 | 1.5 | 100 | 150 | 3 | 50 |
| 90 g/m$^2$) | ≤B5 | 150 | 1 | 150 | 150 | 1.5 | 100 | 150 | 5 | 30 |
| Recycled | A4/LT | 150 | 1 | 150 | 150 | 1 | 150 | 150 | 3 | 50 |
| (60- | LG | 150 | 1 | 150 | 150 | 1.5 | 100 | 150 | 3 | 50 |
| 90 g/m$^2$) | ≤B5 | 150 | 1 | 150 | 150 | 1.5 | 100 | 150 | 5 | 30 |
| Thick | A4/LT | 150 | 1 | 150 | 150 | 1.5 | 100 | 150 | 5 | 30 |
| (91- | LG | 150 | 1 | 150 | 150 | 1.5 | 100 | 150 | 5 | 30 |
| 105 g/m$^2$) | ≤B5 | 150 | 1 | 150 | 150 | 1.5 | 100 | 150 | 7.5 | 20 |
| Envelope | Arbitrary | 150 | 3 | 50 | 150 | 3 | 50 | 150 | 3 | 50 |
| Postcard | Postcard | 150 | 3 | 50 | 150 | 3 | 50 | 150 | 3 | 50 |

k: Added value
H: Detected humidity data (%)
F: Full-count value (sheets)
C: Ejected-sheet stacking capacity (sheets)

In the high-humidity environment (humidity detection data between 50% or more and 80%), stacking failure may occur when more than 100 B5-size sheets of normal paper are stacked on the ejected sheet tray 6. Thus, in this case, the ejected-sheet stacking capacity is changed to 100 (sheets) by increasing the added value k to 1.5 and setting the full-count value (maximum load) at 150.

Thus, when the sheets are associated with a small maximum load (i.e., the sheets tend to develop stacking failure), stacking failure can be prevented by increasing the added value k so as to decrease the number of sheets actually ejected onto the ejected sheet tray 6. Alternatively, as illustrated in table 6, the same effect may be obtained by setting the full-count value (maximum load) depending on the sheet characteristics (paper type, basis weight, and size) and the humidity detection data, with the added value constant. In this case, the full-count value is set in step S31 of FIG. 11, instead of the added value k.

TABLE 6

| Paper | | H < 50 | | | 50 ≤ H < 80 | | | H ≥ 80 | | |
|---|---|---|---|---|---|---|---|---|---|---|
| type | Size | F | k | C | F | k | C | F | k | C |
| Thin | A4/LT | 150 | 1 | 150 | 150 | 1 | 150 | 50 | 1 | 50 |
| (60- | LG | 150 | 1 | 150 | 100 | 1 | 100 | 50 | 1 | 50 |
| 65 g/m$^2$) | ≤B5 | 150 | 1 | 150 | 100 | 1 | 100 | 30 | 1 | 30 |
| Normal | A4/LT | 150 | 1 | 150 | 150 | 1 | 150 | 50 | 1 | 50 |
| (66- | LG | 150 | 1 | 150 | 100 | 1 | 100 | 50 | 1 | 50 |
| 74 g/m$^2$) | B5 | 150 | 1 | 150 | 100 | 1 | 100 | 30 | 1 | 30 |
| Middle | A4/LT | 150 | 1 | 150 | 150 | 1 | 150 | 50 | 1 | 50 |
| (75- | LG | 150 | 1 | 150 | 100 | 1 | 100 | 50 | 1 | 50 |
| 90 g/m$^2$) | B5 | 150 | 1 | 150 | 100 | 1 | 100 | 30 | 1 | 30 |
| Recycled | A4/LT | 150 | 1 | 150 | 150 | 1 | 150 | 50 | 1 | 50 |
| (60- | LG | 150 | 1 | 150 | 100 | 1 | 150 | 50 | 1 | 50 |
| 90 g/m$^2$) | B5 | 150 | 1 | 150 | 100 | 1 | 150 | 30 | 1 | 30 |
| Thick | A4/LT | 150 | 1 | 150 | 100 | 1 | 150 | 30 | 1 | 30 |
| (91- | LG | 150 | 1 | 150 | 100 | 1 | 150 | 30 | 1 | 30 |
| 105 g/m$^2$) | B5 | 150 | 1 | 150 | 100 | 1 | 150 | 20 | 1 | 20 |
| Envelope | Arbitrary | 50 | 1 | 50 | 50 | 1 | 50 | 50 | 1 | 50 |
| Postcard | Postcard | 50 | 1 | 50 | 50 | 1 | 50 | 50 | 1 | 50 |

k: Added value
H: Detected humidity data (%)
F: Full-count value (sheets)

C: Ejected-Sheet Stacking Capacity (Sheets)

Thus, in accordance with the present embodiment, the control unit 60A can clear the count value under more precise conditions, so that false detection of the full-count value (maximum load) of the sheets in the ejected sheet tray 6 can be prevented.

Further, in accordance with the present embodiment, the added value k that is added to the count value for each sheet counted or the full-count value is set in advance depending on the humidity detection data provided by the humidity sensor 67. When the count value reaches the full-count value, the control unit 60A terminates the printing operation. Thus, the number of sheets ejected and stacked on the ejected sheet tray 6 can be appropriately controlled depending on the moisture-absorbed condition of the sheets. Further, the control unit 60A can recognize that the ejected sheet tray 6 is full when the count value reaches the full-count value during the printing operation. Thus, the number of ejected sheets in the ejected sheet tray 6 can be appropriately controlled depending on the moisture-absorbed condition of the sheets.

Next, a method of setting the humidity detection data for the above control process and variations of the foregoing embodiments are described. Because the curled condition of a sheet may vary depending on the water content of the sheet, the relative humidity of the environment in which the apparatus is installed may be used as characteristics indicative of the water content of the sheet. In this case, the humidity detection data used for the control process needs to correspond to the actual water content of the sheet stacked in the sheet feeding cassette 25 of FIG. 1. Generally, a batch of sheets S stored in the sheet feeding cassette 25 is not replaced until all of the sheets have been used. Thus, it may be assumed that the water content of a sheet S during a printing operation corresponds to a maximum humidity detected between the stocking of the sheets in the sheet feeding cassette 25 and the start of the printing operation.

Variation 1

In accordance with Variation 1, the presence or absence of sheets in the sheet feeding cassette 25 is detected by a sheet presence sensor (not shown). After the sheet presence sensor detects the absence of sheets, a maximum humidity value detected between the detection of presence of sheets (e.g., due to re-stocking of sheets) and the start of a printing operation is used as the humidity detection data.

Thus, the moisture-absorbed condition of sheets can be predicted even when the sheets have been left stored in the sheet feeding cassette 25 for a long time, thus enabling the correction of the number of sheets stacked in the ejected sheet tray.

Variation 2

When the stored detecting unit (sheet presence sensor) is not provided, it can be assumed that the image forming apparatus is a small-sized machine with a small sheet-storage capacity of the sheet feeding cassette 25. When the sheet storage amount is small, it can be assumed that the sheets are rarely left unused in the sheet feeding cassette 25. Thus, in accordance with Variation 2, when there is no stored sheet detecting unit (sheet presence sensor), a maximum humidity value detected between the turning-on of the image forming apparatus 200A and the start of a printing operation is used to provide humidity detection data. Thus, in the case of a small-sized image forming apparatus having no stored sheet detecting unit (sheet presence sensor) in the sheet-feeding unit, the moisture-absorbed condition of a sheet is predicted on the assumption that the sheet is set on the sheet-feeding unit at the time of turning on the image forming apparatus. In this way, the ejected sheet stack amount can be appropriately controlled.

Variation 3

In accordance with Variation 3, the control unit 60A clears the maximum value of the humidity detection data when the humidity detected by the humidity sensor 67 decreases below a predetermined humidity. This is based on the fact that the sheets in the sheet feeding cassette 25 tend to be dehumidified when the humidity of the environment is very low.

Thus, in accordance with Variation 3, the decrease in sheet water content during a transition from a high-humidity environment to a low-humidity environment can be predicted, so that an error in the maximum load can be reduced.

Thus, by setting the added value k or the full-count value depending on the sheet type/characteristics data and the humidity detection data, the number of sheets ejected and stacked in the ejected sheet tray can be appropriately controlled depending on the degree of curl due to the sheet characteristics (such as basis weight and size) and the moisture-absorbed condition of the sheets.

The image forming apparatuses 100 and 100A according to the foregoing embodiments are examples of a simple and small-sized full-color printer that does not have an image reading unit (scanner), an automatic document feeder (ADF), or the sheet presence detecting unit for detecting the presence or absence of sheets on the ejected sheet tray 6. However, an image forming apparatus according to another embodiment of the present invention may include an image reading unit and/or an automatic document feeder. The image forming apparatus may further include an operation unit having keys, for example, for entering print instructions into the image forming apparatus, instead of the LCD panel 63 as a notifying unit.

The host PC 200 is merely an example of a print instructing unit and may include any unit, such as a personal computer, capable of externally entering a print instruction into the image forming apparatus. Plural computers may be connected to the image forming apparatus via a communication network. In this case, after the end of a printing operation initiated by a previous print job request from a first print instructing unit, the count value may be cleared unless the next print request is received from a second print instructing unit within the predetermined time.

In another embodiment of the present invention, a sheet presence detecting unit may be installed on the ejected sheet tray 6 so that the user may be alerted via a message on the LCD panel 63 or using a buzzer and the like when the sheets are not removed from the ejected sheet tray 6 in step S7 or S16 in FIG. 8. In this case, however, the full advantages provided by the preceding embodiments of the present invention may not be obtained.

Although this invention has been described in detail with reference to certain embodiments, variations and modifications exist within the scope and spirit of the invention as described and defined in the following claims.

The present application is based on Japanese Priority Application No. 2010-047070 filed Mar. 3, 2010, the entire contents of which are hereby incorporated by reference.

What is claimed is:

1. An image forming apparatus comprising:

an image forming unit configured to form an image on a sheet in a printing operation;

a transport unit configured to transport the sheet via a transport path;

a sheet stacking unit configured to stack the sheet transported by the transport unit;

a sheet detecting unit disposed in the transport path and configured to detect the presence or absence of the sheet in the transport path;

a counting unit-configured to count a number of times that the sheet is detected by the sheet detecting unit in order to determine whether the sheet has been stacked on the sheet stacking unit; and a control unit configured to control the printing operation performed by the image forming unit and the transport unit in accordance with a first print request from a print instructing unit for a print job and based on a count value obtained by adding a value to the count value each time that a sheet is determined to have been stacked on the sheet stack, the value added to the count value being a setting value that is set in advance and is set to a different value depending on a type or characteristic of the sheet, wherein the control unit clears the count value in response to an absence of a next print request from the print instructing unit within a predetermined time after the printing operation associated with the first print job request is completed.

2. The image forming apparatus according to claim 1, further comprising a notifying unit configured to issue a notice when a maximum number of sheets that can be stacked on the sheet stacking unit is reached, wherein the control unit, when the count value is not cleared, causes the notifying unit to issue the notice after causing the image forming unit and the transport unit to continue the printing operation until the maximum number of sheets is reached.

3. The image forming apparatus according to claim 2, further comprising a print continuation setting unit configured to allow the printing operation to continue in response to a user request after the maximum number of sheets is reached.

4. The image forming apparatus according to claim 1, further comprising:

a fusing unit configured to fuse the image onto the sheet, the fusing unit including a heating member and a pressing member configured to be pressed against the heating member, wherein the heating member and the pressing member pressed against the heating member are rotated idly in a curl reducing mode before the sheet is passed between the heating member and the pressing member, and wherein the setting value for the curl reducing mode is different than the setting value for a non-curl reducing mode.

5. The image forming apparatus according to claim 2, wherein the maximum number of sheets can be varied.

6. The image forming apparatus according to claim 1, wherein the control unit is configured to clear the count value in the event of a sheet jam.

7. The image forming apparatus according to claim 1, further comprising:

an open/close member configured to be opened or closed during a jam process for eliminating a sheet jam, wherein the control unit clears the count value when the open/close member is opened.

8. The image forming apparatus according to claim 1, wherein the control unit clears the count value upon replacement of an expendable item used in the image forming apparatus.

9. The image forming apparatus according to claim 1, wherein the control unit clears the count value upon occurrence of an error requiring notification to the user.

10. The image forming apparatus according to claim 1, further comprising;

a humidity detecting unit configured to detect a humidity around the image forming apparatus, wherein the value added to the count value is an added value that is set in advance, a maximum value of the count value is set in advance and the added value is set differently depending on humidity detection data detected by the humidity detecting unit, and the control unit is configured to stop the printing operation when the count value reaches the maximum value.

* * * * *